US005784810A

United States Patent [19]

Bonaventure

[11] Patent Number: 5,784,810

[45] Date of Patent: Jul. 28, 1998

[54] SKI BOOT

[75] Inventor: Laurent Bonaventure, Cran-Gevrier, France

[73] Assignee: Salomon S.A., Cedex, France

[21] Appl. No.: 908,607

[22] Filed: Aug. 8, 1997

Related U.S. Application Data

[63] Continuation of Ser. No. 559,444, Nov. 15, 1995, abandoned.

[30] Foreign Application Priority Data

Dec. 2, 1994 [FR] France ..... 94 14750

[51] Int. Cl.[6] ..... A43B 5/04

[52] U.S. Cl. ..... 36/118.2; 36/118.4; 36/118.8

[58] Field of Search ..... 36/118.2, 118.3, 36/118.4, 118.6, 118.7, 118.8

[56] References Cited

U.S. PATENT DOCUMENTS 5,386,650 2/1995 Storz ..... 36/118.3

FOREIGN PATENT DOCUMENTS 2 682 859 4/1993 France .
2 693 086 1/1994 France .

*Primary Examiner*—Paul T. Sewell
*Assistant Examiner*—Anthony Stashick
*Attorney, Agent, or Firm*—Pollock, Vande Sande & Priddy

[57] ABSTRACT

A ski boot comprising an upper (44) jointed (5) to the shell base (6) and a stiffness-adjustment device (12) which incorporates two support elements (13, 14) connected by a connection member (15) and is associated with a rear support stop (10) incorporated into the upper (44). One (13) of the support elements (13, 14) of the stiffness-adjustment device (12) is rigidly linked to the rear support stop (10) on a common axis of rotation (16) in order to form a rotating assembly (10-13), and the element (13) and the stop (10) are both moved out of center on the same side and by the same value in relation to the axis of rotation (16). The invention makes it possible to adjust the angle of forward motion of the upper (44) without affecting the forward motion-adjustment device (12) by simple rotation of the rotating assembly (10-13).

5 Claims, 4 Drawing Sheets

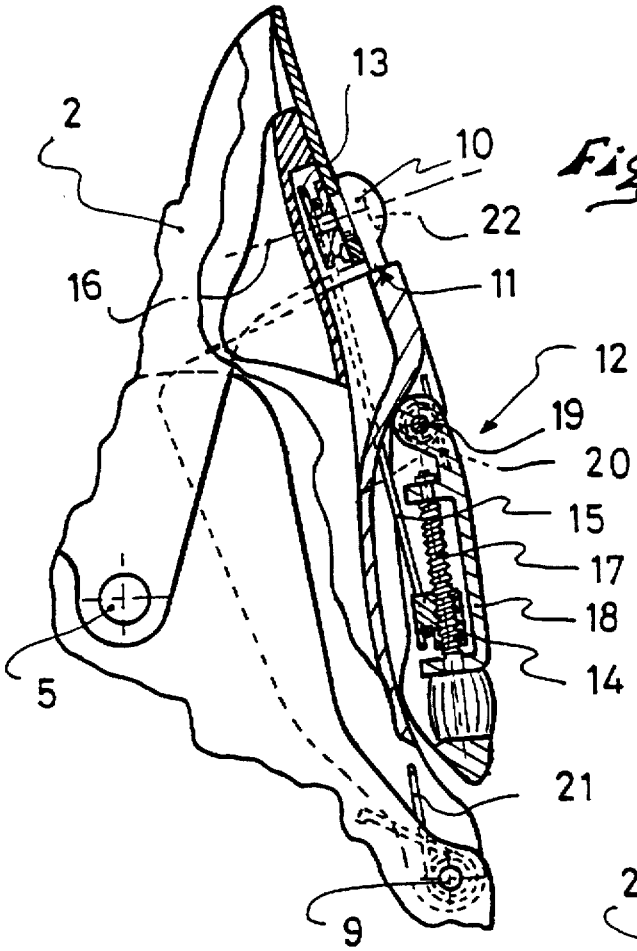
Fig: 5
Fig: 3
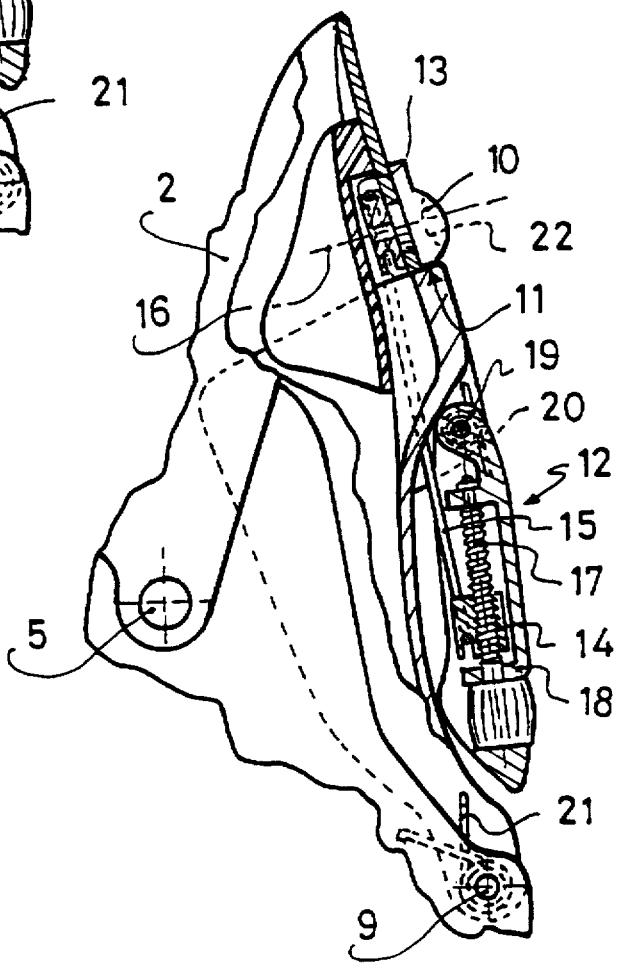
Fig: 1a
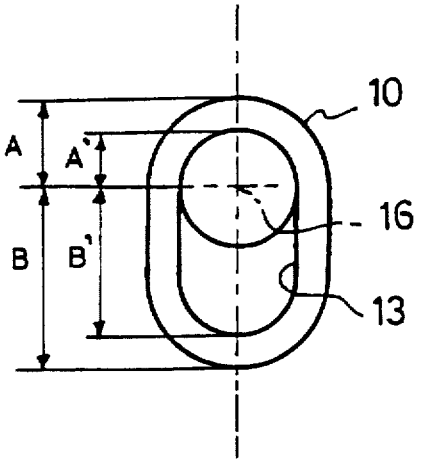

SKI BOOT

This application is a continuation of U.S. patent application Ser. No. 08/559,444, filed Nov. 15, 1995 now abandoned.

FIELD OF THE INVENTION

The present invention concerns an alpine ski boot comprising a shell base surmounted by an upper at least partially articulated around an axis of the shell base, between two support elements arranged on both the upper and the shell base, which together delimit an angular amplitude of pivoting motion under forward flection of the upper in relation to an initial forward-motion reference position, based on which this amplitude, and, consequently, the stiffness of the upper, can be adjusted by means of an adjustment device connecting the support elements.

BACKGROUND OF THE INVENTION

The pivoting motion or flection of an upper can be controlled in conventional fashion in relation to the shell base in alpine ski boots of this kind, in particular those disclosed in French Patent No. 2 693 086.

This patent discloses an alpine ski boot comprising a shell base surmounted by an upper incorporating front and rear parts made of single or multiple pieces and at least partially articulated around an axis of the shell base in a back-to-front or front-to-back direction between two support elements arranged on the upper and on the shell base, which together delimit an angular amplitude of pivoting motion under forward flection of the upper in relation to an initial forward-motion reference position, beginning at which this amplitude, and thus the stiffness, of the upper can be adjusted by means of an adjustment device interposed between the support elements, a minimum amplitude corresponding to maximum stiffness, and vice-versa.

The amplitude-adjustment device determining the stiffness of the upper is constituted by a flexible, inextensible connection member arranged between the elements supporting the jointed upper and the shell base and which form the coupling points of this connection member, whose course of travel between these points can be modified in order to impart to it a state of maximum tension or a state of controlled release corresponding to the initiation of slackness, this state being of such a nature as to give the upper a predetermined, adjustable angular amplitude of forward pivoting motion by means of a control device acting directly or indirectly on the tension condition of the connection member. In this type of boot, the initial forward-motion position of the upper is made adjustable. To this end, the rear support element located on the shell base also acts as a rear support stop for the upper and is fitted for this purpose with vertical adjustment means making it possible to position it at differing heights.

The advantage of this arrangements lies in the fact that adjustment of the angle of forward motion by changing the position of the rear support element does not change the operation of the device adjusting the stiffness of the upper, since the relative position of the support elements of this device remains identical. However, this advantageous configuration of the forward-motion-adjustment device linked to the stiffness-adjustment device requires, disassembly/reassembly of the rear support element, and this proves to be troublesome to the skier. In fact, an operation of this kind is difficult and lengthy, since it is necessary not only to have a disassembly/reassembly tool, but also to mark out the height of the position of the rear support element on the shell base after adjustment, in order to establish the identical position on both of the skier's boots. Furthermore, under normal skiing conditions, that is, in the presence of snow and temperatures that are most frequently low, this operation, which requires a degree of dexterity and entails the risk of losing the disassembled parts, is rendered virtually impossible for the skier.

SUMMARY OF THE INVENTION

The present invention is intended to remedy these problems by proposing a ski boot of the type mentioned hereinafter and comprising a forward-motion adjustment which, associated with a stiffness-adjustment device, can be easily executed even under skiing conditions using ordinary means available to the skier, e.g., keys, coins, the end of a belt, or the like, without requiring disassembly/reassembly and in such a way that the forward-motion adjustment does not affect the stiffness adjustment.

To this end, the ski boot comprises a shell base surmounted by an upper at least partially articulated around an axis on a shell base. The angular pivoting motion of the upper is restricted using a so-called "stiffness-control" device incorporating two support elements respectively arranged on the upper and on a part belonging to the shell base and joined by a connection member. One of these support elements is linked to a rear support element or stop designed to determine the initial forward motion position of the upper, and is so linked on a common axis of rotation, thus forming a rotating assembly. The support element and the rear support stop are both moved off-center to the same side and to the same extent in relation to the axis of rotation of the rotating assembly.

One advantage of this arrangement is that, when the rotating assembly is turned, the forward motion position of the upper and the position of the support element belonging to the connection member of the stiffness-control device are simultaneously modified by variable magnitudes that are inversely proportional. Accordingly, the length of the connection member between the two support elements of the stiffness-control device remains constant, whatever the rotational position of the rear support stop. Therefore, the forward-motion adjustment has no effect on stiffness control, despite the coupling of these two separate functions.

Another advantage lies in the fact that the rotating assembly remains fixed in position on the part of the boot on which it is mounted. This positioning obviates the need to mark out the height of the position of the rear support stop on the shell base or on the upper. Moreover, since only a simple rotation of the rotating assembly, and not disassembly, is needed to adjust the forward motion of the upper, no specific devices and/or tools are required, and the time required to effect this procedure is very short. It is obvious that the rotating assembly is advantageously fitted with means such as a recess or a raised part designed to allow the rotation thereof manually with or without the use of an ordinary object commonly available to the skier, for example a coin, the end of a belt, a key, or the like.

According to various embodiments, the rotating assembly comprises a shoulder forming the rear forward motion-adjustment support stop and a pulley constituting the support element of the stiffness-control device, the contour of the latter being made progressive, for example over 360°, or simply over 180°. Advantageously, an indexing system may be associated with the rotating assembly in order to hold it in its position of rotational adjustment.

The rotating assembly can be mounted either on the boot upper or on the part belonging to the shell base, since its function is to mediate between them in order to cause their relative pivoting motion around the linkage axis.

The support element and the rear support stop forming the rotating assembly are moved more or less off-center in relation to their axis of rotation, as a function of the maximum degree of desired change of forward motion of the upper. In fact, the degree of the off-center position determines the degree of the variation of forward motion in a directly proportional manner.

BRIEF DESCRIPTION OF THE DRAWINGS

The invention will be better understood upon reading of the following description supplied with reference to the attached drawings showing, by way of example, several embodiments thereof.

FIGS. 1 to 5 illustrate schematically a first embodiment of the invention applied to a front entry-type ski boot incorporating a flap allowing insertion of the heel of the skier's foot and in which adjustment of the forward motion coupled to the stiffness-control device is mounted on the upper.

FIG. 1 is a side elevation of the boat, with the upper forward motion-adjustment device being in a position of minimum forward motion.

FIG. 1A shows an example of how the rear support element and the support elements of the stiffness-control device are moved off-center in relation to their axis of rotation.

FIG. 2 is a schematic rear elevation of the boot in FIG. 1.

FIG. 3 is a detail view of the construction of the device as seen along the line III—III in FIG. 2.

FIGS. 4 and 5, counterparts to FIGS. 3 and 4, show the boot in FIG. 1, the upper forward motion adjustment device being in a position of maximum forward motion.

DESCRIPTION OF PREFERRED EMBODIMENTS

Figure 1:
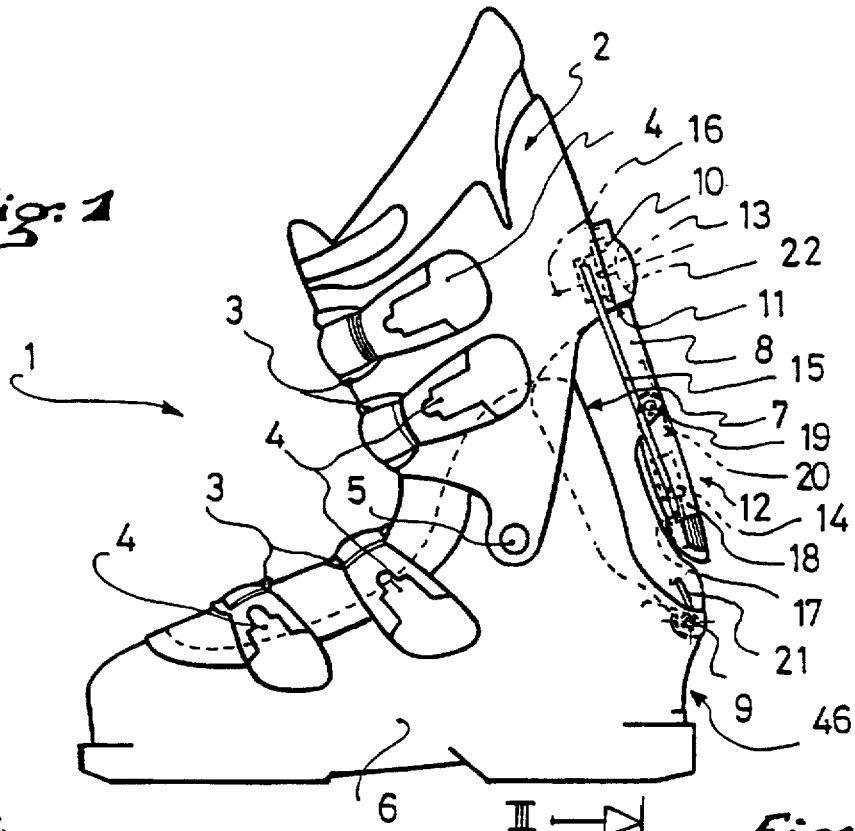
Figure 4:
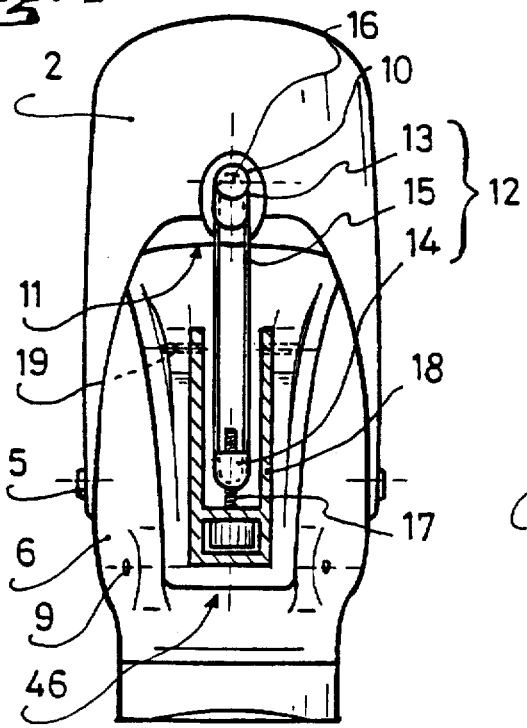
Figure 2:
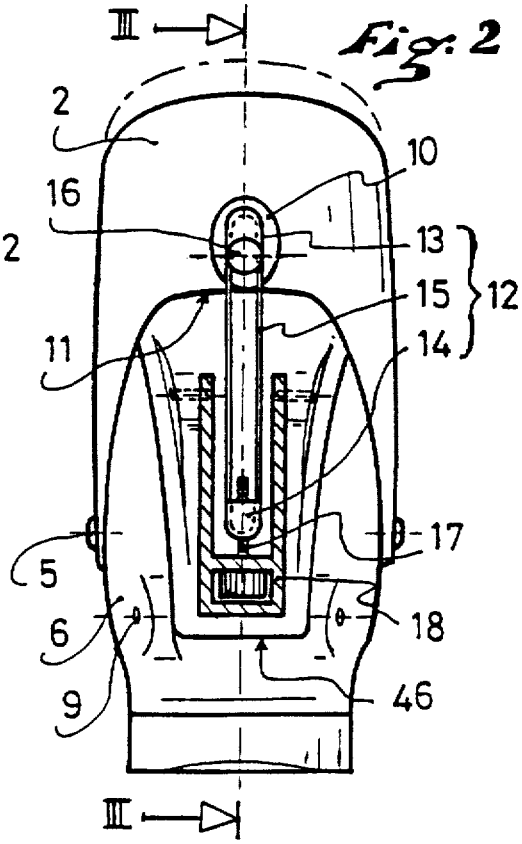

As illustrated in FIGS. 1 to 5, the front- and/or central-entry ski boot 1 comprises an upper/collar 2 adjustable over the skier's lower leg by means of transverse flaps 3 and closure systems 4. The upper/collar 2 is articulated around an axis 5 located on the shell base 6 substantially in the area of the malleoli. The boot 1 has, in the dorsal area of the heel-piece of its shell base 6, a vertical groove 7 open at the top and closed by a retractable flap 8 whose lower part is jointed 9 to the shell base in the lower area 46 of the heel-piece. This flap, closes off the groove 7 in the skiing position of the boot while blocking the rearward motion of the upper 2, and is designed to allow the insertion of the heel of the skier's foot in order to facilitate the process of putting on and taking off the boot.

The rearward motion of the upper is blocked by the upper part of the flap 8, which, in the skiing position, fits, by means of a support area 11, beneath a rear support stop 10 carried by the upper/collar. The forward angular pivoting motion of the upper/collar is limited by a stiffness-control device 12. This device 12 comprises (a) an upper element 13 arranged on the upper 2, and a lower support element 14 arranged on the retractable flap 8 jointed to the shell base 6; and (b) a connection member 15 joining upper and lower support elements 13 and 14. This connection member 15 is adjustable between a state of maximum tension which blocks the forward motion of the upper/collar 2, and a state of relatively pronounced relaxation giving a degree of freedom of forward pivoting motion to the upper 2. In the embodiment shown, the connection member 15 is adjusted by moving the support element 14 in translational motion on the threaded rod 17 of a pivoting lever 18. This lever 18 is jointed 19 in the upper area of the flap 8 and is closed by a downward rocking motion performed either manually or automatically, for example using a kickover spring 20 which interacts between the lever and the flap 8. During skiing, the flap is held in the closed position beneath the upper/collar 2; that is, the rear support stop 8 remains continuously opposite its support zone 11.

Advantageously, the flap 8 follows the forward flection movements of the upper/collar 2. To this end, an elastic device 21, such as a spring, may be provided to interact between the flap 8 and the shell base 6 and, therefore, to ensure the return motion and the maintenance of the flap 8 in the locked position beneath the upper/collar 2. During the process of putting on or removing the boot, it then becomes necessary to raise the lever 18 belonging to the stiffness-adjustment device 12 in order to allow the flap 8 to be moved to the rear when the skier's heel is inserted.

The upper support element 13 of the stiffness-control device 12 is rigidly linked to the rear support stop 10 along a common axis of rotation 16, which, in this case, is embodied by a cylindrical bearing surface constituting an extension of stop 10, thereby forming a rotating assembly 10-13. This assembly incorporates a pulley constituting the support element 13 of the stiffness-control device 12, and a shoulder or rear support stop 10, on which the upper/collar 2 is supported to the rear. According to another feature, the support element 13 and the stop 10 are both moved off-center to the same side and by the same amount in relation to the axis of the rotating assembly, as illustrated, for example, in FIG. 1A. In fact, the outer contour of the rear support stop 10, which is offset in relation to the axis of rotation 16, produces a gap whose value corresponds to B-A, the equivalent of that of the gap B'-A' of the rear support element 13.

Accordingly, rotation of rotating assembly 10-13, which remains fixed in position on the rear part of the upper/collar 2, generates, (a) the pivoting motion of the collar/upper about its axis 5 in relation to the support zone 11 of the flap 8, and, therefore, in relation to the shell base 6, moving it either farther away (FIGS. 4 and 5) or closer (FIGS. 2 and 3); and, (b) release or tensioning of the connection 15 member which is inversely proportional to the relative travel of the upper/collar 2 in relation to the support zone 11. In fact, when the upper/collar 2 pivots forward (FIG. 3 and 4), the offset pulley 13 causes release of a part of the length of the connection member 15, and when the upper/collar 2 is moved backward (FIGS. 2 and 3), the connection member 15 is coiled to a greater degree, still using the offset pulley 13. As a result of this arrangement, the length of the connection member between support elements 13 and 14 remains constant, while the upper/collar 2 is adjusted in a position of relatively pronounced forward motion in relation to the shell base 6.

To allow easy adjustment of the rotating assembly 10-13, the rear support stop 10 is fitted with a hollow recess 22, e.g., a screwdriver slot long and wide enough to permit the use of a coin, a key, a belt end, and the like. The rear support stop 10 may, conversely, incorporate a projection designed to be grasped manually or by means of an ordinary tool in order to be rotated.

Figure 6:
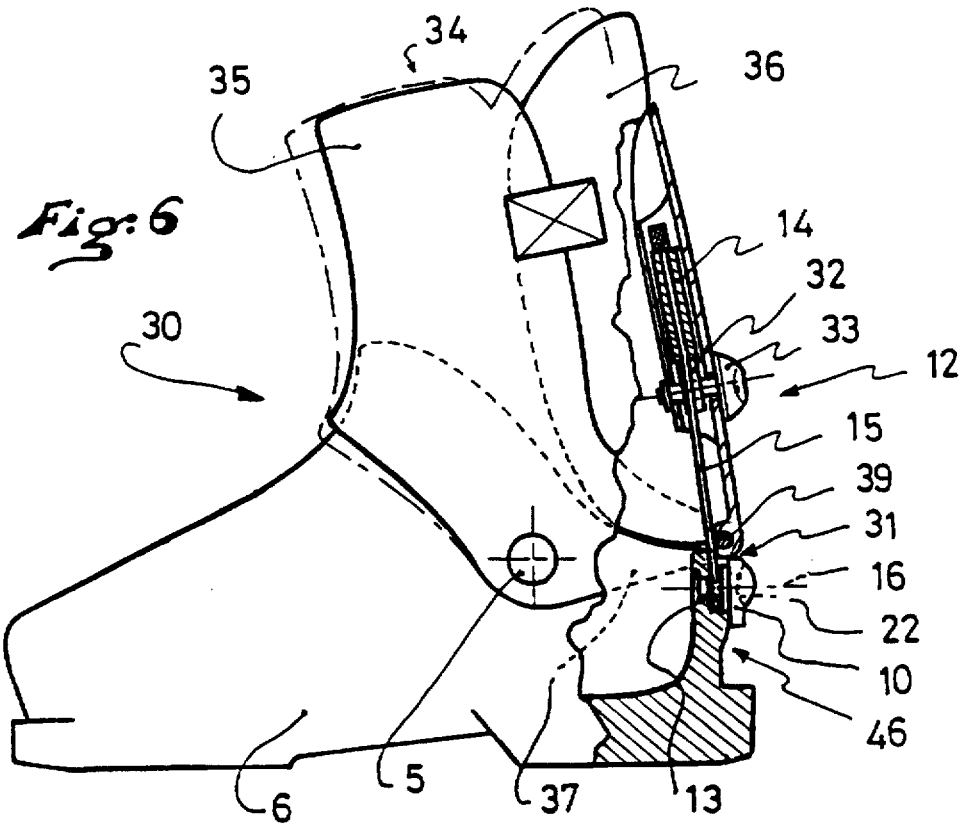
FIG. 6 is a side elevation which shows schematically a second embodiment of the invention in which the rotating part constituting the forward motion-adjustment device is mounted on the shell base of a rear-entry ski boot seen in partial longitudinal cross section in a position of minimum forward motion.

In the embodiment shown in FIG. 6, the rear-entry ski boot 30 is provided with a stiffness-adjustment device 12 comparable to the one in FIGS. 1–5. As before, the latter comprises support elements 13–14 and a connection member 15. The length of this connection member is adjusted by means of a rotating cam 32 which, when controlled by a turn knob 33, pushes the support element 14 more or less away from the stationary element 13, thus modifying the tension or relaxation of connection member 15, and, therefore, the freedom of the upper 34 to bend forward. This upper 34 has two parts namely, a collar 35 jointed at 5 to shell base 6 and a rear cover 36 jointed at 39 to rear lugs 37 forming one piece with the collar.

In this embodiment, the stiffness-control device 12 is incorporated into the rear part of the upper 35 consisting of the rear cover 36, and the stationary support element 13 associated with the rear support stop 10 is mounted in the lower area 46 of the heel-piece of the shell base 6. The support area 31 designed to cooperate with the stop 10 is, in this case, located on the lower part of the upper 34 located opposite it.

Figure 7:
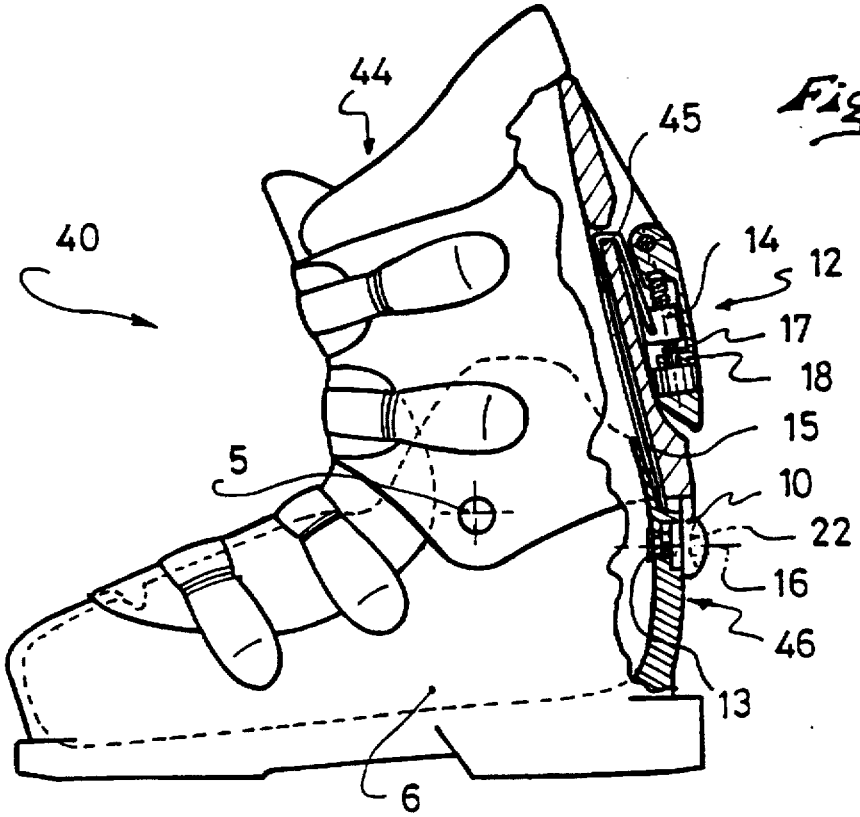
FIG. 7 is a side elevation of a front-entry ski boot provided with forward motion adjustment coupled to a stiffness-control device by means of a rotating part according to the invention.

In FIG. 7, the front-entry ski boot 40 comprises an upper/collar 44 extending to the lower area 46 of the heel-piece of the shell base 6. In this embodiment, the stiffness-control device 12, with its two support elements 13 and 14 and its connection member 15, comprises a support reversing device 45 for the connection member 15, whose tension is adjusted using the support element 14, which can travel in translation on a threaded rod 17 belonging to the lever 18.

Figure 8:
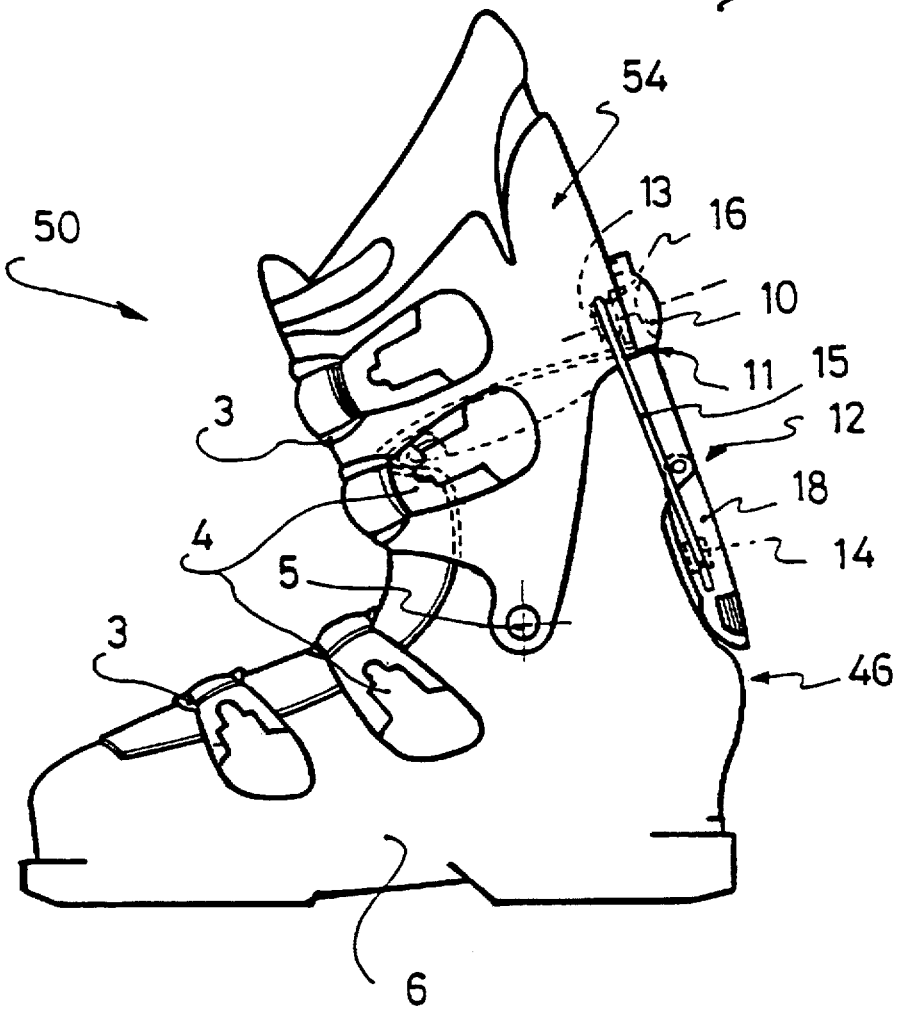
FIG. 8 is a side elevation of a front-entry ski boot comparable to the one in FIG. 1, but without a heel-insertion flap.

In FIG. 8, the front-entry ski boot 50 is comparable to the boot described with reference to FIGS. 1 to 5, the basic difference being that the dorsal area of the heel-piece of the shell base 6 is closed, i.e., that it is not opened by a groove equipped with a retractable flap allowing insertion of the heel. In this embodiment, the support zone 11 is located on the upper part of the heel-piece of the shell base 6 located opposite the rear support stop 10 carried by the upper/collar 54.

In the preceding embodiments of the rotating assembly 10-13, the support element 13 and the rear support stop 10 have a variable contour extending progressively over 180°.

In this embodiment, conventional indexing means are designed to lock the rotating assembly 10-13 in any intermediate position whatever between the two end positions determined by their eccentricity. In this way, forward motion can be adjusted in a multitude of positions.

It is also possible to provide a contour variable over 180° such that it is not progressive, and, in particular, that it be rectangular, so that only two forward motion positions of the upper 2, 34, 44, 54 of the boot 1, 30, 40, and 50 can be obtained.

It is obvious that the rotating assembly 10-13 can be freely rotated over 360° or be restricted to a lesser angle, and that the contour of the support element 13 and of the rear support stop 13 can also be progressive over 360° or over a lesser angle.

What is claimed is:

1. A ski boot comprising a shell base (6) surmounted by an upper (2, 34, 44, 54) jointed to said shell base around an axis (5) and a stiffness-control device (12) for limiting angular pivoting motion of said upper, said stiffness-control device comprising an upper support element (13) in the form of a pulley arranged on the upper (2, 34, 44, 54) and a lower support element (14) arranged on a part of the shell base (6), said upper and lower support elements being connected by a connection member (15), one of said upper and lower support elements (13, 14) being associated with a shoulder forming a rear support stop (10) of the upper (2, 34, 44, 54), wherein the upper support element (13) of said stiffness-control device is rigidly linked to the rear support stop (10) along a common axis of rotation (16) embodied by a cylindrical bearing surface constituting an extension of said rear support stop (10), thus constituting a rotating assembly (10-13), and wherein the upper support element (13) and the rear support stop (10) are both moved off-center on a same side and by a same value in relation to the axis of rotation (16) of said rotating assembly (10-13), said rotating assembly remaining in fixed position on a part of said boot on which it is mounted.

2. The ski boot according to claim 1, wherein the rotating assembly (10-13) is equipped with means for producing rotation (22, 33).

3. The ski boot according to claim 2, wherein the rotating assembly (10-13) embodies an outer edge that is progressive over 180°0.

4. The ski boot according to claim 1, wherein the rotating assembly (10-13) is mounted on the rear part of the upper (2, 54) of said boot (1, 50).

5. A ski boot comprising a shell base (6) surmounted by an upper (2, 34, 44, 54) jointed to said shell base around an axis (5) and a stiffness-control device (12) for limiting angular pivoting motion of said upper, said stiffness-control device comprising a lower support element (13) in the form of a pulley arranged on a part of the shell base and an upper support element (14) arranged on the upper, said upper and lower support elements being connected by a connection member (15), one of said upper and lower support elements (13, 14) being associated with a shoulder forming a rear support stop (10) of the upper (2, 34, 44, 54), wherein the upper support element (13) of said stiffness-control device is rigidly linked to the rear support stop (10) along a common axis of rotation (16) embodied by a cylindrical bearing surface constituting an extension of said rear support stop (10), thus constituting a rotating assembly (10-13), and wherein the upper support element (13) and the rear support stop (10) are both moved off-center on a same side and by a same value in relation to the axis of rotation (16) of said rotating assembly (10-13), said rotating assembly remaining in fixed position on a part of said boot on which it is mounted.

* * * * *